US005515557A

United States Patent [19]

Spurlin

[11] Patent Number: 5,515,557

[45] Date of Patent: May 14, 1996

[54] METHOD AND SYSTEM FOR MOUNTING A PUMP IN AN ADJUSTABLE MANNER TO A WHIRLPOOL

[75] Inventor: Richard T. Spurlin, Fayetteville, Ga.

[73] Assignee: Spurlin Industries, Inc., Palmetto, Ga.

[21] Appl. No.: 533,320

[22] Filed: Sep. 25, 1995

[51] Int. Cl.[6] ..... B08B 3/02

[52] U.S. Cl. ..... 4/541.1; 4/584; 417/361

[58] Field of Search ..... 4/541.1, 584; 248/289.11, 248/667; 417/360, 361

[56] References Cited

U.S. PATENT DOCUMENTS

| | | | |
|---|---|---|---|
| 1,007,590 | 10/1911 | Miller | 248/289.11 |
| 1,276,601 | 8/1921 | Whiting | 248/667 X |
| 4,198,673 | 4/1980 | Kropp et al. | 417/360 X |
| 4,857,112 | 8/1989 | Franninge | 4/541.1 X |
| 4,942,630 | 7/1990 | Kantor et al. | 4/541.1 X |
| 5,352,058 | 10/1994 | Munro et al. | 248/289.11 X |

*Primary Examiner*—Richard E. Gluck
*Attorney, Agent, or Firm*—Jones & Askew

[57] ABSTRACT

An improved method and system for mounting a pump to a whirlpool. The pump mounting system includes a mounting platform for mounting a pump and a support member for connection of the mounting platform, and thus, the pump, to the underside of a whirlpool. The mounting platform is rotatably connected to a support member so that the pump can be rotated as necessary to install the whirlpool without interference from the pump.

10 Claims, 2 Drawing Sheets

116
134
138
136
140
141
132
141
147
147
145
145
120
172b
122
180
146
142
146
148
180
182
182
144
150
152
124
168
148
172a 162
120
166
160
164c
122
124
144
164b
164a

METHOD AND SYSTEM FOR MOUNTING A PUMP IN AN ADJUSTABLE MANNER TO A WHIRLPOOL

TECHNICAL FIELD

The present invention relates generally to whirlpools for bathing and relaxing, and more particularly to a method and system for mounting a pump in an adjustable manner to a whirlpool.

BACKGROUND OF THE INVENTION

Whirlpools are well known in the prior art. A whirlpool is generally an open vessel that may be used for bathing or soaking. A whirlpool includes a pump that is connected to hoses and water jets to provide a user with comforting streams of water. To minimize the cost of constructing and installing whirlpools, a whirlpool is often sold as a complete unit with the pump, hoses, and water jets already mounted onto the whirlpool.

During the whirlpool manufacturing process, a pump is typically mounted to a whirlpool by the use of a static board. The board is usually a wafer board or other similar type of inexpensive board. The board is attached at one end to the underside of the whirlpool with a layer of reinforcing material. The layer of reinforcing material extends over the board to bond with a prior layer of reinforcing material and thereby attach the board to the underside of the whirlpool. The pump is then attached to the free end of the board to secure the pump to the whirlpool. The pump is generally attached to the board via a base of the pump. The base of the pump includes a plurality of holes formed therein for receiving bolts or other similar fasteners. The fasteners extend though the holes of the base of the pump into corresponding holes drilled in the board. Attached in this fashion, the pump is fixed in its position with respect to the whirlpool.

During installation of the whirlpool, however, the fixed position of the pump may cause problems. The pump's position must often be adjusted relative to the whirlpool so that the whirlpool will fit into the area in which the whirlpool is to be installed. The pump's fixed position is adjusted by first removing the pump from the board. This is accomplished by removing the fasteners that secure the pump to the board. The pump is then moved to a position over, or at least partially over, the board where the pump will not interfere with the installation of the whirlpool. If the pump is not at least partially over the board, the pump cannot be reattached to the board. Next, new holes that correspond to the new position of the holes in the base of the pump are drilled into the board. The pump is then reattached to the board with the fasteners.

The use of a static board in pump installation, however, includes significant limitations. From an installation standpoint, adjustment of the pump is both time consuming and costly. Labor and time is required to remove the pump from the board, to determine a position for the pump over the board in which the pump will not interfere with the installation of the whirlpool, to drill new holes, and to reattach the pump. Furthermore, tools, such as a drill, must be transported to the installation site. A source of power must also be supplied to operate the drill and any other tools. Additionally, there are post-installation problems with the use of the static board in pump installation. Often, the pump has been necessarily moved to a position where the pump is only partially over the board. As a result, the pump hangs over an edge of the board and creates vibrations that can interfere with a user's enjoyment of the whirlpool. Thus, this method does not provide an adequate pump mounting system.

Additionally, there are problems with the static board caused by the nature of the construction material. The static board is subject to share distortion due to moisture conditions common to a whirlpool's environment. The static board may sag, or otherwise lower itself toward or to the floor from its suspended position. This sagging causes stress to the piping attached to the pump. In extreme conditions, as may be caused by leaks resulting from this stressed condition, the static board will deteriorate completely.

Therefore, there exists a need in the art for an improved method and system for mounting a pump to a whirlpool. The pump mounting system should be inexpensive and easy to use. Further, the pump mounting system should allow the pump to be readily adjusted to a position where the pump will not interfere with the installation of the whirlpool. Additionally, the system should allow a pump to be easily adjusted or removed with minimal tools.

SUMMARY OF THE INVENTION

The present invention solves the problems in the art by providing an improved method and system for mounting a pump to a whirlpool. Generally stated, the pump mounting system comprises a mounting platform for mounting a pump and a support member for connection of the mounting platform, and thus, the pump, to the underside of a whirlpool. The mounting platform is rotatably connected to the support member so that the pump's location can be rotated as necessary. Advantageously, the method and system allow a whirlpool to be inexpensively and easily installed.

In the preferred embodiment, the pump is attached to a top side of the mounting platform. An opposite bottom side of the mounting platform includes a post extending downwardly from the bottom side. The post of the mounting platform is received by a hollow projection that extends upwardly from a first section of the support member. The post is rotatable with respect to the hollow projection so that the mounting platform is rotatable relative to the support member. A second elongated section of the support member is integral with the first section and includes a pair of elongated legs extending from the first section. The elongated legs are substantially parallel. A brace extends between the elongated legs for structural support. The second elongated section is attached to the underside of the whirlpool by a layer of reinforcing material. The reinforcing material extends over the second section to bond with a prior layer of reinforcing material. Thus, the position of the pump can be readily adjusted by rotating the mounting platform as necessary. Accordingly, use of the adjustable pump support results in a significant savings in time, labor and cost.

After the position of the pump is adjusted as desired, the mounting platform is secured relative to the support member to prevent further movement of the pump. The mounting platform is secured relative to the support member by a fastener. The fastener extends through the first section of the support member into the post of the mounting platform to secure the mounting platform relative to the support member. Thus, the pump can be easily adjusted during installation of the whirlpool to prevent interference therewith and can be thereafter secured to prevent movement of the pump during operation of the whirlpool.

Thus, it is an object of the present invention to provide an improved method and system for mounting a pump to a whirlpool.

It is another object of the present invention to provide a method and system for mounting a pump to a whirlpool so that the position of the pump can be adjusted as necessary.

It is still another object of the present invention to provide a standard method and system for mounting a pump to a whirlpool that can be used with any type of whirlpool.

It is a further object of the present invention to provide a method and system for mounting a pump to a whirlpool so that the pump can be adjusted about the center of gravity of the pump.

It is still a further object of the present invention to provide an inexpensive method and system for mounting a pump to a whirlpool and adjusting the position of the pump as necessary.

It is still a further object of the present invention to provide a construction for mounting a pump to a whirlpool which is permanent in nature and will not deteriorate or sag to cause fault with the whirlpool system.

It is still a further object of the present invention to provide a mounting support for a pump to a whirlpool which will provide orientation of the pump in directions more continuous with the piping of the whirlpool, thereby avoiding the need for elbows and providing lesser restriction to water flow and improved whirlpool performance.

Further objects, features and advantages of the present invention will become apparent upon reviewing the following description of the preferred embodiments of the invention, when taken in conjunction with the drawings and appended claims.

DETAILED DESCRIPTION

Figure 1:
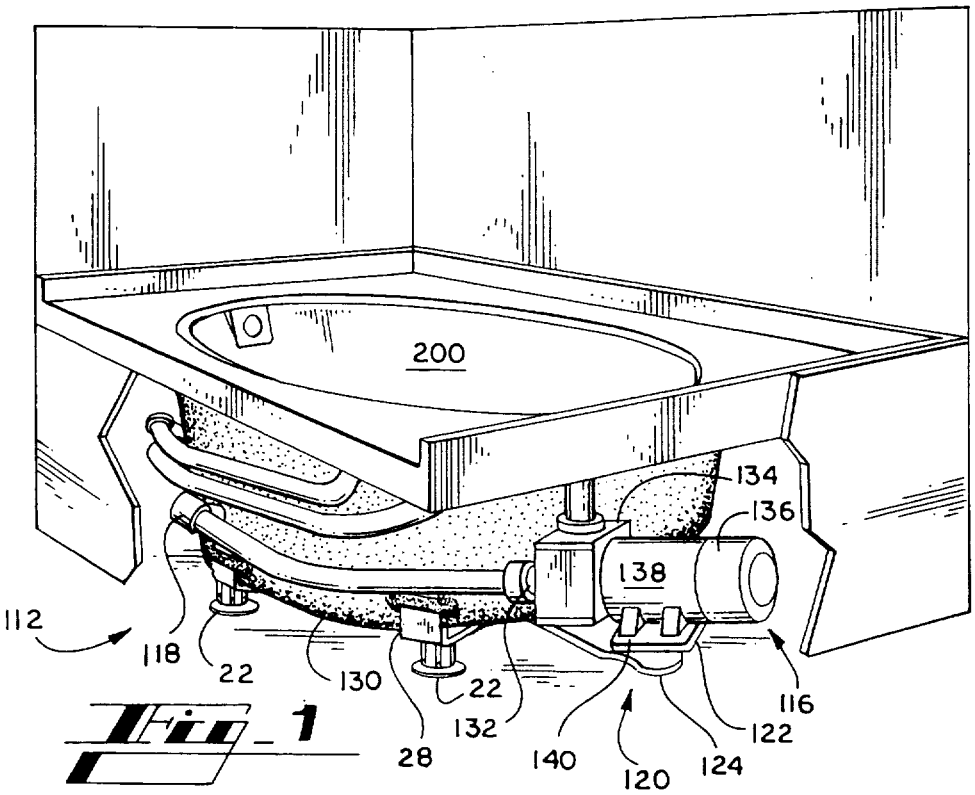
FIG. 1 is a perspective view of a installed whirlpool and the preferred adjustable support of the present invention.
Figure 4:
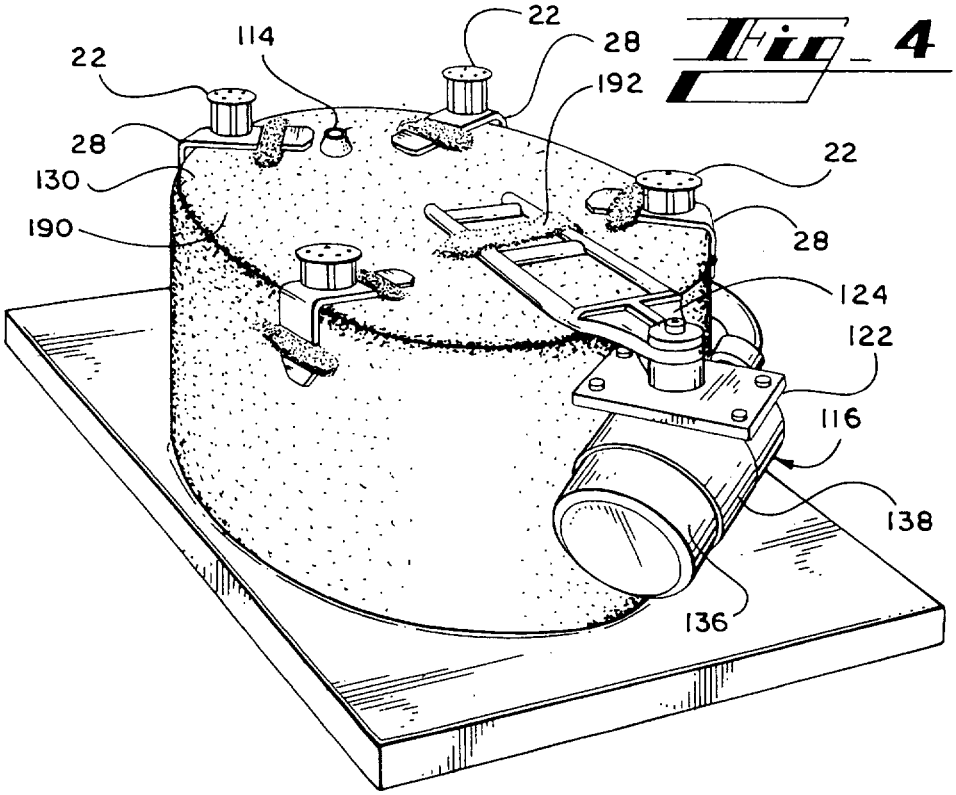
FIG. 4 is a perspective view of the whirlpool preferred adjustable support of FIG. 1, and the attachment of the preferred adjustable support to the underside of the whirlpool.

Referring now in more detail to the drawings, in which like numerals refer to like parts throughout the several views, FIG. 1 shows a whirlpool 112 installed in accordance with the preferred embodiment of the present invention. The preferred embodiment is generally offered for sale by the assignee of the present invention under the trademark MOUNTRITE. As used herein the term "whirlpool" includes a tub, hot tub, or other similar vessel including a pump and that is used for bathing, for relaxing, or for holding fluids. In the preferred embodiment, the whirlpool 112 is used for relaxing and for bathing. Briefly described, the whirlpool 112 is an open, oval-shaped vessel having a bottom sloping downwardly to a drain 114 (FIG. 4). The whirlpool 112 includes a pump 116 that provides comforting streams of water via hoses 118 and water jets (not shown). Those skilled in the art, however, will understand that the present invention may be advantageously used in connection with any type of whirlpool.

In accordance with the present invention, the pump 116 is mounted to the whirlpool 112 through the use of an adjustable support 120. The adjustable support 120 allows the position of the pump 116 to be adjusted as necessary relative to the whirlpool 112. Thus, the position of the pump can be easily adjusted so that the whirlpool can be installed without interference from the pump. The position of the pump also can be easily adjusted in case the whirlpool needs to be accessed for repair or service, or for any other reason. The pump 116 does not have to be removed from the support 120 for adjustment to its position. Further, the adjustment to the position of the pump does not require the pump to be remounted in a new position.

In the preferred embodiment, the adjustable support 120 comprises a mounting platform 122 for mounting the pump 116. The adjustable support also comprises a support member 124 for connecting the mounting platform 122, and thus the pump, to the whirlpool 112. Preferably, the mounting platform 122 is journaled to the support member 124 so that the pump 116 can be rotated relative to the whirlpool 112. Additionally, the mounting platform 122 is preferably journaled to the support member 124 along an axis extending through the center of gravity of the pump 116. Thus, the weight of the pump 116 will remain directed at a select location of the support member 124 regardless of the orientation of the pump. Accordingly, the structural integrity of the adjustable support 120 is maintained for all orientations of the pump 116.

For the preferred whirlpool 112, which is oval-shaped, the support member 124 is attached to the underside 130 of the whirlpool opposite the drain 114. Those skilled in the art, however, will understand that the support member 124 may be attached at a different location of the whirlpool 112 within the scope of the present invention.

Description of the Pump

Figures 2, 3:
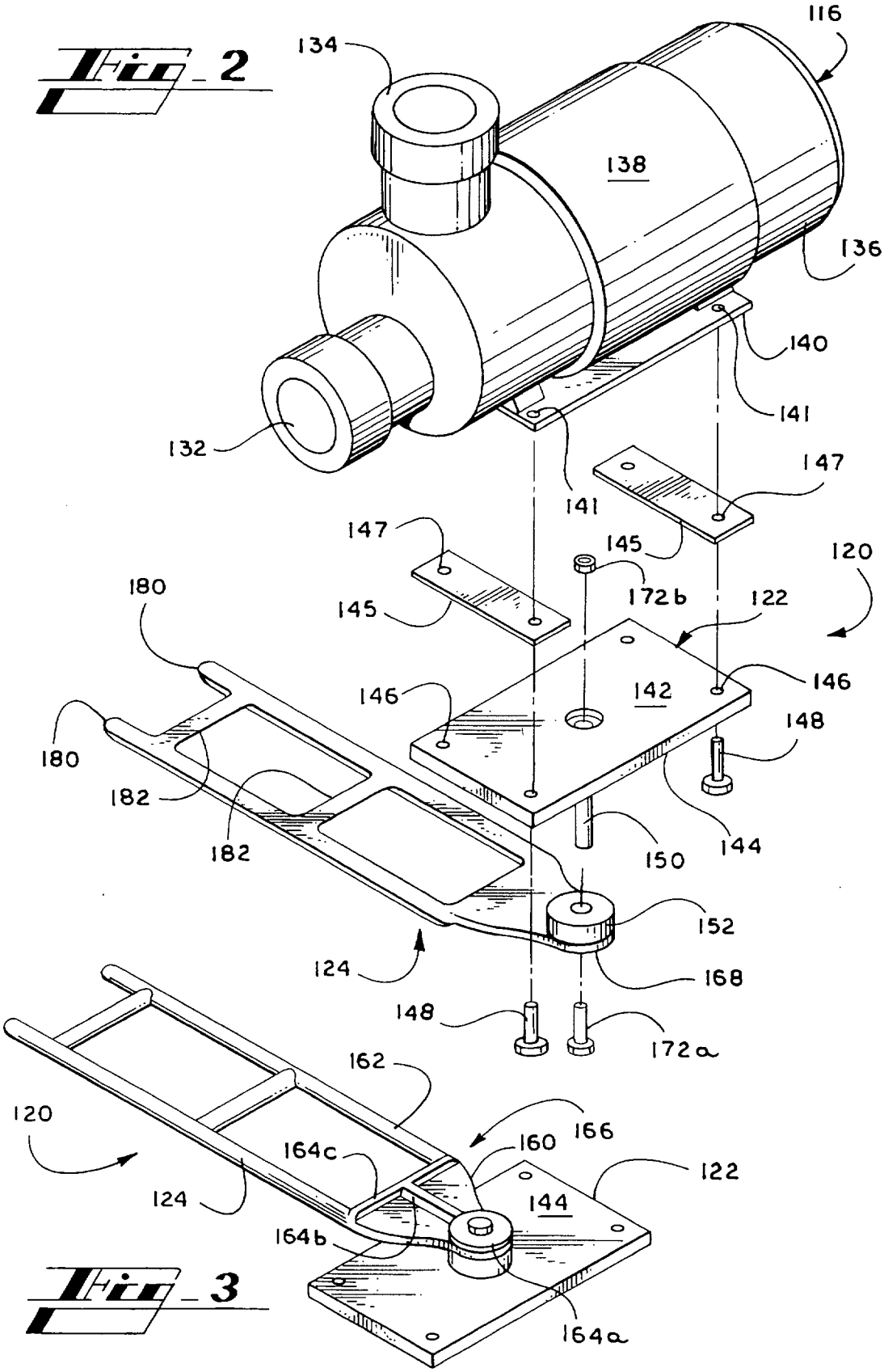
FIG. 2 is an exploded view of the adjustable support of FIG. 1.
FIG. 3 is a perspective view of the adjustable support of FIG. 1, showing the mounting platform secured to the support member in accordance with the preferred embodiment of the present invention.

FIG. 2 illustrates the pump 116 in association with the preferred adjustable support 120, and in particular, in association with the mounting platform 122 and the support member 124. In the preferred embodiment, the pump 116 is a centrifugal pump having a water inlet 132 and a water outlet 134. The water inlet 132 and the water outlet 134 are connected to the water jets of the whirlpool 112 by flexible hoses 118 to facilitate adjustment of the pump 116 relative to the whirlpool 112. In the preferred embodiment, a rigid hose is used to the water inlet 132. A flexible hose is used from the water outlet 134 to a distance normally not to exceed 18 inches in length until it connects either to a whirlpool jet, or a rigid pipe. However, it will be apparent to those skilled in the art to use all flexible pipe, all rigid pipe or a combination of flexible/rigid pipe.

Water is driven through the pump by an electric motor 136. The preferred pump 116, which includes a sleeve 138 secured to the motor 136 for permanent attachment therewith. The sleeve 138 connects a base 140 for mounting the pump 116 to the pump. The base 140 of the pump 116 includes a plurality of holes 141 formed therein for receiving fasteners to secure the pump to an object. As those skilled in the art will understand, however, other methods of securing the pump 116 to an object can be used within the scope of the present invention.

Description of the Mounting Platform

FIG. 2 also illustrates the mounting platform 122 in association with the pump 116 and the support member 124. As shown by FIG. 2, the mounting platform 122 preferably includes a top side 142 and an opposite bottom side 144. The top side 142 is preferably substantially the same size and shape of the base 140 of the pump 116 so that the pump is fully supported by the mounting platform 122. The top side 142 of the mounting platform 122 includes a plurality of holes 146 for mounting the pump 116 thereon. The holes 146 correspond to, and are in substantial alignment with, the holes 141 in the base 140 of the pump 116.

The pump 116 is mounted to the top side 142 of the mounting platform 122 by a set of fasteners 148. The fasteners 148 extend though the holes 141 in the base 140 of the pump 116 into the corresponding holes 146 in the mounting platform 122 to secure the pump to the mounting platform. As those skilled in the art will understand, however, other methods of securing the pump 116 to the mounting platform 122 can be used within the scope of the present invention. For example, the pump 116 can be secured to the mounting platform 122 with clamps extending over the edges of the base 140 of the pump.

A pair of flexible cushions 145 are preferably disposed between the pump 116 and the mounting platform 122. There, the flexible cushions 145 function as shock absorbers to minimize the transmission of vibrations of the pump 116 to the mounting platform 122. Such pump vibrations can interfere with a user relaxation in the whirlpool 112. The flexible cushions 145 are held in place by the fasteners 148, which extend through holes 147 in the flexible cushions 145. In the preferred embodiment, the flexible cushions 145 are constructed of a durable rubber.

The opposite bottom side 144 of the mounting platform 122 includes a post 150 extending downwardly from the bottom side. Preferably, the post 150 is cylindrical. The post 150, as discussed in detail below, is journaled into a hollow projection 152 of the support member 124. Accordingly, the mounting platform 122, and thus, the pump 116, can be rotated relative to the support member 124.

In the preferred embodiment, the post 150 extends downwardly from a center of the bottom side 144 of the mounting platform 122. Thus, the post 150 is preferably journaled to the support member 124 along an axis extending through the center of gravity of the pump 116. As a result, the weight of the pump 116 remains directed at the hollow projection 152 of the support member 124 regardless of the orientation of the pump. Accordingly, the structural integrity of the adjustable pump support 120 is maintained for all orientations of the pump 116.

The mounting platform 122 is preferably constructed of a light weight material that is resistant to water corrosion. In the preferred embodiment, the mounting platform 122 is of fiberglass construction. The process for fiberglass construction is well known and therefore will not be further discussed herein.

Description of the Support Member

FIG. 2 further illustrates the preferred support member 124 in association with the pump 116 and the mounting platform 122. As shown by FIG. 2, and discussed in detail below, the support member 124 connects the mounting platform 122, and thus the pump 116, to the underside 130 of the whirlpool 112. The support member 124 preferably includes a first section 160 and a second elongated section 162. As noted above, a hollow projection 152 extends upwardly from the first section 160. The hollow projection 152 is preferably cylindrical and is sized to receive the post 150 of the mounting platform 122. The post 150 of the mounting platform 122 is journaled into the hollow projection 152. Thus, the post 150 is rotatable inside the hollow projection 152 so that the mounting platform 122 is rotatable relative to the support member 124. As a result, the position of the pump 116 can be easily adjusted by rotating the mounting platform 122. Accordingly, the pump 116 can be adjusted as necessary relative to the whirlpool 112.

FIG. 3 illustrates the preferred adjustable support 120, from below, and in particular illustrates the support member 124 connected to the mounting platform 122 as seen from below. As shown by FIG. 3, the first section 160 preferably includes a plurality of integral reinforcing segments 164 on an opposite side 165 of the first section to provide the first section with additional strength. A first reinforcing segment **164*a* is disposed directly opposite the hollow projection 152. A second reinforcing segment 164*b* extends from the first reinforcing segment 164*a* to an edge 166 where the first section 160 is in contact with the second section 162. A third reinforcing segment 164*c* extends along the edge 166 where the first section 160 is in contact with the second section 162. The reinforcing segments 164 provide the first section with additional strength under hollow projection 152, which is the point of contact between the support member 124 and the mounting platform 122. As explained above, the center of gravity of the pump 116 remains directed at the hollow projection 152 for all orientations of the pump. Accordingly, the reinforcing segments 164 serve as gravel to the prevention of structural failure of the support member 124** for all orientations of the pump.

As best illustrated in FIG. 2, the first section 160 of the support member 124 preferably has a hole 168 formed at the bottom 170 of the hollow projection 152 for receiving a fastener 172. The fastener 172 extends through the hole 168 of the first section 160 into the post 150 of the mounting platform 122. In the preferred embodiment, the fastener 172 comprises a bolt **172*a* and a mating nut 172*b*. As explained in detail below, the fastener 172 secures the hollow projection 152 relative to the post 150 of the mounting platform 122 after the pump 116 has been adjusted to a desired position. Consequently, the pump 116 is prevented from rotating relative to the whirlpool 112 after the adjustable support 120** has been secured in position.

The second elongated section 162 of the support member 124 is integral with the first section 160. The second elongated section 162 includes a pair of elongated legs 180 that extend away from the edge 166 where the first section 160 is in contact with the second section 162. Preferably, the elongated legs 180 are substantially parallel to one another. The second elongated section 162 also preferably includes a pair of braces 182 to maintain the elongated legs 180 in parallel relation. The braces 182 are whirlpooled apart from one another and extend between the elongated legs 180.

As described below in detail, the second elongated section 162 is attached to the underside 130 of the whirlpool 112 by a layer of reinforcing material 190. The reinforcing material 190 extends over the second elongated section 162 to bond with a prior layer of reinforcing material 192.

The support member 124 (including the integral reinforcing segments 124) is preferably constructed of a light weight material that is resistant to water corrosion. In the preferred embodiment, the support member 124 is of fiberglass construction. Fiberglass construction is well known and therefore will not be further discussed herein.

Description of the Attachment of the Support Member to the Spa

The preferred system and method for attaching the support member 124 to the whirlpool 112 will now be described. In the preferred embodiment, the whirlpool 112 is conventionally constructed of a vacuum formed acrylic shell 200. As those skilled in the art will understand, the whirlpool 112 may be constructed of other materials within the scope of the present invention. The process of vacuum forming the acrylic shell 200 is well known in the art and therefore will not be further described herein. The acrylic shell 200 is reinforced with a filled resin material mixed with fiberglass strands. The use of resin filled with calcium carbonate or other similar material is preferred because it is non-flammable. Such reinforcing materials are well known in the art and therefore will not be further described herein.

The acrylic shell 200 is reinforced with a first layer 192 of calcium carbonate filled resin material mixed with fiberglass strands. This reinforcing material is sprayed directly onto the back (not shown) of the acrylic shell 200 to form the underside 130 of the whirlpool 112. The second elongated section 162 of the support member 124 is then preferably placed on the underside 130 of the whirlpool 112. As described above, the support member 124 is placed on the underside 130 of the whirlpool 112 opposite the drain. Next, a second layer of reinforcing material 190 is preferably sprayed across the second elongated section 162 of the support member 124. The second layer of reinforcing material 190 extends over the second elongated section 162 to bond with a prior layer of reinforcing material 192 and to thereby attach the support member to the underside 130 of the whirlpool 112.

In the preferred embodiment, brackets 28 for receiving adjustable supports 22 for leveling the whirlpool 112 are similarly attached to the underside 130 of the whirlpool 112. Thus, the brackets are also bonded to the whirlpool 112 between the first and second layers of reinforcing material. Further information regarding the brackets 28 or the adjustable supports 22 is available in patent application Ser. No. 08/533,365, entitled "A METHOD AND SYSTEM FOR INSTALLING A TUB," which is filed concurrently with the present application, is commonly assigned, and is incorporated herein by reference.

FIG. 4 illustrates the preferred attachment of the preferred adjustable support 120 to the whirlpool. In particular, FIG. 4 illustrates the attachment of the support member 124 to the whirlpool, of the mounting platform 122 to the support member 124, and of the pump 116 to the mounting platform 124. As described above, the support member 124 is preferably attached to the whirlpool 112 during the whirlpool manufacturing process. Additionally, the pump 116 is preferably attached to mounting platform 122 and the mounting platform 122 is attached to the support member 124 during the whirlpool manufacturing process. Accordingly, in the preferred embodiment, the whirlpool 112 is sold and shipped as a complete unit. During shipment, the fastener 172 secures the hollow projection 152 of the support member 124 relative to the post 150 of the mounting platform 122. Consequently, the pump 116 is prevented from rotating relative to the whirlpool 112 during shipment of the whirlpool and thereby prevented from damaging the hoses 118.

In the preferred installation process, the whirlpool 112 is placed next to the location where it will be installed. At this point, the position of the pump 116 may prevent installation of the whirlpool 112. To install the whirlpool 112 in such a case, the fastener 172 is loosened with a wrench. The pump 116 is then adjusted to a position where the pump will not interfere with installation of the whirlpool 112. This adjustment is accomplished by rotating the mounting platform 122 relative to the whirlpool as necessary. Once the pump 116 is positioned to where the pump will not interfere with installation of the whirlpool 112, the fastener 172 is tightened with the wrench. The tightened fastener prevents the pump 116 from rotating relative to the whirlpool 112 during operation of the whirlpool.

Thus, in accordance with the present invention, the whirlpool 12 is easily and inexpensively installed. Moreover, the minimal tool needed for installation is a wrench with which to loosen and tighten the fastener 172.

From the foregoing description of the preferred embodiments and the several alternatives, other alternative constructions of the present invention may suggest themselves to those skilled in the art. For example, an offset may be added between the mounting platform 122 and the support member to increase the area in which the pump 116 may be positioned. In this embodiment, however, the center of gravity will not necessarily remain focused at the hollow projection 152 of the support member 124. In addition, the support member may be a static. A set of plates rotatable to each other may be employed between the pump 116 and the static board to make the pump adjustable in accordance with the present invention. Therefore, the scope of the present invention is to be limited only to the claims below and the equivalents thereof.

I claim:

1. An adjustable support for mounting a pump to a whirlpool, comprising:

(a) a mounting platform, said mounting platform comprising:

(1) a top side, said top side comprising a plurality of holes for use in mounting said pump on said mounting platform; and (2) a bottom side opposite to said top side, said bottom side comprising a post, said post extending downwardly from said bottom side;

(b) a support member connecting said mounting platform to said whirlpool, said support member comprising:

(1) a first section comprising a hollow projection, said hollow projection extending upwardly from said first section, wherein said hollow projection is sized to receive said post of said mounting platform, and wherein said post is rotatable with respect to said hollow projection so that said mounting platform is rotatable relative to said support member; and (2) a second elongated section integral with said first section, said second elongated section comprising a pair of elongated legs extending from said first section, said elongated legs being substantially parallel, and a brace, said brace extending between said elongated legs, said second elongated section being attached to the underside of said whirlpool;

(c) a fastener for selectively securing said mounting platform to said support member, said fastener extending through said first section of said support member into said post of said mounting platform to selectively secure said mounting platform to said support member; and (d) a layer of reinforcing material for attaching said second elongated section of said support member to an underside of said whirlpool, said layer of reinforcing material extending over said second elongated section of said support member at a first end thereof, said layer of reinforcing material bonding with a prior layer of reinforcing material to attach said first section of said support member to said underside of said whirlpool, whereby said pump is rotatable relative to said whirlpool so that said pump may be rotated as necessary to install said whirlpool without interference from said pump.

2. An adjustable support for mounting a pump to a whirlpool, comprising:

(a) a mounting platform for mounting said pump;

(b) means for mounting said pump on said mounting platform;

(c) a support member for connecting said mounting platform to said whirlpool;

(d) means for rotatably connecting said mounting platform to said support member; and (e) means for attaching said support member to an underside of said whirlpool.

3. The adjustable support for mounting a pump as recited in claim 2, wherein said pump comprises a base for mounting said pump to said mounting platform, said base of said pump comprising a plurality of base holes formed therein for receiving a like number of fasteners for securing said pump to said mounting platform;

wherein said mounting platform comprises a plurality of platform holes formed therein for receiving said fasteners, said platform holes corresponding to, and in alignment with said base holes in said base of said pump; and wherein said fasteners extend through said base holes in the base of said pump into said platform holes in said mounting platform to secure said pump to said mounting platform.

4. The adjustable support for mounting a pump as recited in claim 3, wherein said means for mounting said pump to said mounting platform comprises a flexible cushion, said flexible cushion positioned between said pump and said mounting platform.

5. The adjustable support for mounting a pump as recited in claim 2, wherein said support member comprises a first section, said first section comprising a hollow projection, said hollow projection extending upwardly from said first section;

wherein said mounting platform comprises a bottom side, said bottom side comprising a post; said post extending downwardly from said bottom side; and wherein said means for rotatably connecting said mounting platform to said support member comprises said post of said mounting platform journaled in said hollow projection of said support member so that said pump is rotatable relative to said whirlpool.

6. The adjustable support for mounting a pump as recited in claim 5, further comprising means for selectively securing said post relative to said hollow projection.

7. The adjustable support for mounting a pump as recited in claim 6, wherein said means for selectively securing said post relative to said hollow projection comprises a fastener, said fastener extending through said first section of said support member into said post of said mounting platform.

8. The adjustable support for mounting a pump as recited in claim 7, wherein said fastener comprises a bolt and a mating nut.

9. The adjustable support for mounting a pump as recited in claim 2, wherein said support member comprises a second elongated section, said second elongated section comprising a pair of substantially parallel legs and a brace, said brace extending between said substantially parallel legs; and wherein said means for attaching said support member to said underside of said whirlpool comprises a layer of reinforcing material, said layer of reinforcing material extending over said second elongated section of said support member, said layer of reinforcing material bonding with a prior layer of reinforcing material to attach said second elongated section of said support member to said underside of said whirlpool.

10. A method for mounting a pump to a whirlpool so that said pump may be adjusted as necessary to install said whirlpool without interference from said pump, comprising the steps of:

(a) attaching a support member to an underside of the whirlpool by depositing a layer of reinforcing material over said support member at a first end thereof, said layer of reinforcing material extending over said support member to bond with a prior layer of reinforcing material;

(b) connecting a mounting platform to said support member so that said mounting platform can rotate relative to said support member;

(c) mounting said pump on said mounting platform;

(d) adjusting said mounting platform as necessary so that said whirlpool can be installed without interference from said pump; and (e) in response to said mounting platform being positioned so that said whirlpool can be installed without interference from said pump, securing said mounting platform relative to said support member.

* * * * *